US011346541B2

(12) United States Patent
Van Rensburg

(10) Patent No.: US 11,346,541 B2
(45) Date of Patent: May 31, 2022

(54) HEAT SINK

(71) Applicant: Frederick Janse Van Rensburg, Delray Beach, FL (US)

(72) Inventor: Frederick Janse Van Rensburg, Delray Beach, FL (US)

( * ) Notice: Subject to any disclaimer, the term of this patent is extended or adjusted under 35 U.S.C. 154(b) by 315 days.

(21) Appl. No.: 16/326,680

(22) PCT Filed: Aug. 16, 2017

(86) PCT No.: PCT/IB2017/054974
§ 371 (c)(1),
(2) Date: Feb. 19, 2019

(87) PCT Pub. No.: WO2018/033864
PCT Pub. Date: Feb. 22, 2018

(65) Prior Publication Data

US 2019/0264903 A1 Aug. 29, 2019

(30) Foreign Application Priority Data

Aug. 19, 2016 (ZA) ..... 2016/05777

(51) Int. Cl.
*F21V 29/00* (2015.01)
*F21V 29/77* (2015.01)
(Continued)

(52) U.S. Cl.
CPC ..... *F21V 29/77* (2015.01); *F21V 19/0045* (2013.01); *F21V 29/503* (2015.01);
(Continued)

(58) Field of Classification Search
CPC .... F21V 19/0045; F21V 29/77; F21V 29/503; F21V 29/89; F21Y 2103/10; F21Y 2115/10
See application file for complete search history.

(56) References Cited

U.S. PATENT DOCUMENTS

2002/0131238 A1* 9/2002 Fisher ..... H01L 23/40 361/719
2003/0048641 A1* 3/2003 Alexanderson ..... B60Q 3/47 362/470

(Continued)

FOREIGN PATENT DOCUMENTS

WO WO-2015069104 A1 * 5/2015 ..... F21V 19/004

*Primary Examiner* — Gerald J Sufleta, II
(74) *Attorney, Agent, or Firm* — Michael D. Eisenberg

(57) ABSTRACT

The invention relates to a heat sink (10, 60, 120, 150) having a body (12) which includes a channel-shaped mounting formation configured to hold an electronic unit (40) in the form of an LED strip captive therein. The channel-shaped mounting formation defines has a slot which includes a mouth (22) having a transverse width which is less than a width of the electronic unit (40), and a nook (30) which is configured to permit mounting of the electronic unit (40) to the heat sink by passing the electronic unit through the mouth (22) and angularly displacing the electronic unit (40) relative to the mounting formation of the body (12). Instead of sliding the LED strip into the slot, which could damage the strip or result in poor application of thermal paste, the strip is mounted by applying paste and angularly and transversely displacing the strip relative to the body.

22 Claims, 7 Drawing Sheets

(51) Int. Cl.

| | |
|---|---|
| ***F21V 29/503*** | (2015.01) |
| ***F21V 29/89*** | (2015.01) |
| ***F21V 19/00*** | (2006.01) |
| ***F21V 29/70*** | (2015.01) |
| *F21Y 103/10* | (2016.01) |
| *F21Y 115/10* | (2016.01) |
| *F21S 4/28* | (2016.01) |
| *F21V 29/74* | (2015.01) |

(52) U.S. Cl.
CPC ..... *F21V 29/70* (2015.01); *F21V 29/89* (2015.01); *F21S 4/28* (2016.01); *F21V 29/74* (2015.01); *F21Y 2103/10* (2016.08); *F21Y 2115/10* (2016.08)

(56) References Cited

U.S. PATENT DOCUMENTS

2006/0146502 A1* 7/2006 Mayer ..... F21V 19/0045 361/720
2006/0146540 A1* 7/2006 Reo ..... F21V 31/005 362/332
2011/0031864 A1* 2/2011 Rebergen ..... F21V 19/04 313/11
2011/0163341 A1* 7/2011 Van Elmpt ..... F21V 29/70 257/98
2012/0314431 A1* 12/2012 Lin ..... F21V 19/0045 362/382
2012/0320571 A1* 12/2012 Kim ..... F21V 21/005 362/147
2013/0301273 A1* 11/2013 Chu ..... F21V 29/70 362/294

* cited by examiner

HEAT SINK

FIELD OF THE INVENTION

This invention relates to a heat sink. More particularly, the invention relates to a heat sink for improved heat dissipation from an electronic unit. The invention further relates to a method of mounting an electronic unit to a heat sink and to a method of manufacturing a heat sink.

BACKGROUND OF THE INVENTION

A printed circuit board (PCB) mechanically supports and electrically connects electronic components using conductive tracks, pads, and other components, typically etched from copper sheets, which are laminated onto a non-conductive substrate.

Electronic components mounted on PCBs generate heat which, if not properly managed, may damage components, shorten their lifespan and/or cause failures. Examples of electronic components which may be subject to these issues are processors, transistors and diodes.

A heat sink is a passive heat exchanger which can be used to manage heat generated by a heat source in the form of one or more electronic components. A heat sink transfers heat from electronic components to a fluid medium (e.g. air), where it is dissipated away from the electronic components. A heat sink is typically made from a material with desirable heat exchange properties, such as copper or aluminium. In the Applicant's experience, in applications where excessive mass is a concern, aluminium is generally used.

In some applications, heat dissipation portions of heat sinks are shaped and dimensioned so as to increase a surface area in contact with the fluid medium for enhanced heat dissipation.

Electronic components are typically mounted to conductive tracks on a first side of a PCB (hereinafter referred to as "the component side") by way of soldered connections. As a result, a portion of the heat generated by the electronic components is operatively conducted to the PCB.

It may be expensive or impractical to provide a dedicated heat sink for each individual electronic component. Furthermore, it may in some cases be impractical to do so, for instance, when a heat sink would block light operatively emitted by a light emitting diode (LED). Instead of providing dedicated heat sinks for individual electronic components, a single heat sink can be mounted to a second side of the PCB (hereinafter referred to as "the track side"). A PCB may in such cases be provided with an additional conductive layer, such as an aluminium layer, to facilitate the dissipation of heat from the component side to the track side.

In light of the fact that air is a poor conductor of heat, a thermal paste (also known as a heat paste or "thermal grease") is typically applied between the PCB and the heat sink to which it is mounted, to serve as an interface between the PCB and heat sink, facilitating the dissipation of heat away from the PCB. Thermal paste is typically applied to one or both of the heat sink and the PCB such that it at least partially contacts an interface surface of the heat sink and the track side of the PCB.

Thermal paste typically consists of a polymerizable liquid matrix and large volume fractions of electrically insulating, but thermally conductive filler. Typical matrix materials are epoxies, silicones, urethanes, and acrylates, solvent-based systems, hot-melt adhesives, and pressure-sensitive adhesive tapes. Aluminium oxide, boron nitride, zinc oxide, and aluminium nitride may be used as fillers.

As mentioned above, it is desirable to limit the presence of air between the PCB and the heat sink by applying a thermal paste therebetween. It is also desirable to limit the thickness of thermal paste required, as the thermal conductivity of thermal paste, while higher than that of air, is typically lower than that of the heat sink material.

In the Applicant's experience, a PCB is typically mounted to a track side heat sink by sliding the PCB along elongate mounting formations extending along a length of the heat sink.

For instance, in the case of many tubular LED lighting arrangements, the arrangement includes an elongate PCB provided with an LED strip and an elongate heat sink (typically made from aluminium). The heat sink includes mounting formations which define a longitudinally extending channel, complementally shaped to the PCB. To assemble the arrangement, thermal paste may be applied to the interface surface of the heat sink, after which the PCB is slid into the channel along the length of the heat sink until its entire length is received therein.

In the Applicant's experience, there are numerous disadvantages associated with existing track side heat sink configurations and methods of mounting a PCB to a heat sink having one of these configurations. In particular, the Applicant has found that it is difficult to apply thermal paste evenly and to provide a relatively thin layer thereof when longitudinally sliding the PCB and the heat sink in relation to each other. Moreover, it may be difficult to ensure that an entire interface surface area between the PCB and heat sink, or a substantial portion thereof, is covered with thermal paste.

The Applicant has also found that the sliding motion required to assemble or mount the PCB to the heat sink may cause damage to the PCB, in some cases even leading to short circuits or faulty tracks.

Embodiments of the present invention aim to address the issues identified above, at least to some extent.

SUMMARY OF THE INVENTION

In accordance with a first aspect of the invention, there is provided a heat sink having a body which includes a channel-shaped mounting formation configured to hold an electronic unit captive therein, the channel-shaped mounting formation defining a mouth having a transverse width which is less than a width of the electronic unit, and a nook which is configured to permit mounting of the electronic unit to the heat sink by passing the electronic unit through the mouth and angularly displacing the electronic unit relative to the mounting formation of the body.

The mounting formation may be configured removably to hold the electronic unit captive therein.

The body may be elongate. The body may be configured for heat exchange with the electronic unit. The channel-shaped mounting formation may define a slot extending along a longitudinal axis of the body. The slot may be configured to receive the electronic unit by relative angular and transverse displacement of the electronic unit and the mounting formation of the body. The mounting formation may further be configured removably to hold the electronic unit captive in the slot.

The slot may include the mouth and an inner receiving region which includes the nook which is disposed toward one side. The inner receiving region may have a transverse width which is greater than the width of the electronic unit. The inner receiving region may be configured to permit the electronic unit to be received therein via the mouth by relative angular and transverse displacement of the electronic unit and the body.

The channel-shaped mounting formation may be configured such that the electronic unit is receivable in the nook of the inner receiving region via the mouth by:

angling the electronic unit relative to the mounting formation such that the electronic unit is inclined relative to an interface surface of the mounting formation;

inserting a side of the electronic unit into the nook of the inner receiving region; and angularly displacing the electronic unit relative to the mounting formation about the longitudinal axis until the electronic unit is contiguous with the interface surface of the mounting formation and is held captive in the inner receiving region.

When the electronic unit is entirely received within the inner receiving region, a contact surface of the electronic unit may be in abutment with the interface surface of the mounting formation.

A thermally conductive substance or compound may be sandwiched between the contact surface of the electronic unit and the interface surface of the mounting formation to facilitate effective heat dissipation from the electronic unit to the body of the heat sink.

The nook may extend lengthwise and may be dimensioned to permit a length and a portion of the width of the electronic unit to be received therein when the electronic unit is inclined relative to an interface surface of the mounting formation.

At least part of the nook may be defined by an inclined sidewall of the mounting formation.

The channel-shaped mounting formation may include a pair of inwardly orientated, opposing lips which extend lengthwise and define the mouth between them.

The electronic unit may include a printed circuit board (PCB) having a component side to which at least one electronic component is mounted and an opposite contact surface. The PCB may include a series of light emitting diodes (LEDs) on the component side thereof.

The body may be made from aluminium. The channel-shaped mounting formation may be configured to receive an electronic unit having a width of 75 mm or less. The electronic unit may have a length of at least 100 mm.

The heat sink may include a resilient spacer which is accommodated in the nook and is configured to urge a side of the electronic unit into abutment with the channel-shaped mounting formation to inhibit lateral or transverse movement of the electronic unit relative to the mounting formation.

A lip opposite to the nook may be wedge-shaped and configured to urge the electronic unit into contact with an interface surface of the mounting formation.

The heat sink may include at least one shim removably inserted between the channel-shaped mounting formation and a component side of the electronic unit.

The body may include a heat dissipation portion on a side of the body opposite to the channel-shaped mounting formation. The heat dissipation portion may have a semi-cylindrical shape.

Alternatively, the heat dissipation portion may have a series of radially extending, angularly spaced apart fins.

Also, the heat dissipation portion may be substantially planar and may have attachment formations for fitting the heat sink to a mounting plate of a light fitting such that the planar heat dissipation portion is in thermal contact with the mounting plate for effective heat dissipation.

The invention extends to a method of mounting an electronic unit to a heat sink as described above, the method including the steps of:

applying a thermally conductive substance to an interface surface of the channel-shaped mounting formation and/or to a contact surface of the electronic unit; and mounting the electronic unit to the heat sink by passing the electronic unit through the mouth and angularly and transversely displacing the electronic unit relative to the channel-shaped mounting formation of the body until the electronic unit is held captive by the mounting formation.

The step of angularly and transversely displacing the electronic unit relative to the mounting formation may include:

angling the electronic unit relative to the mounting formation such that the electronic unit is inclined relative to the interface surface of the mounting formation;

inserting a side of the electronic unit into the nook;

angularly displacing the electronic unit relative to the mounting formation about a longitudinal axis of the body until the electronic unit is contiguous with the interface surface of the mounting formation; and slidably displacing the electronic unit laterally away from the nook until it is held captive by the mounting formation.

The method may further include:

inserting a resilient spacer into the nook before the electronic unit is mounted to the heat sink.

Also, the method may include, once the electronic unit is mounted to the channel-shaped mounting formation, inserting a shim between the mounting formation and a component side of the electronic unit.

The slot may be configured to receive an electronic unit having a width of 75 mm or less, preferably 50 mm or less, more preferably 25 mm or less. The slot may be configured to receive an electronic unit having a length of 100 mm or more, preferably 200 mm or more, more preferably 300 mm or more.

BRIEF DESCRIPTION OF THE DRAWINGS

The invention will now be further described, by way of example, with reference to the accompanying drawings.

In the drawings.

DETAILED DESCRIPTION OF EXAMPLE EMBODIMENTS

The following description of the invention is provided as an enabling teaching of the invention. Those skilled in the relevant art will recognise that many changes can be made to the embodiments described, while still attaining the beneficial results of the present invention. It will also be apparent that some of the desired benefits of the present invention can be attained by selecting some of the features of the present invention without utilising other features. Accordingly, those skilled in the art will recognise that modifications and adaptations to the present invention are possible and can even be desirable in certain circumstances, and are a part of the present invention. Thus, the following description is provided as illustrative of the principles of the present invention and not a limitation thereof.

Figure 1:
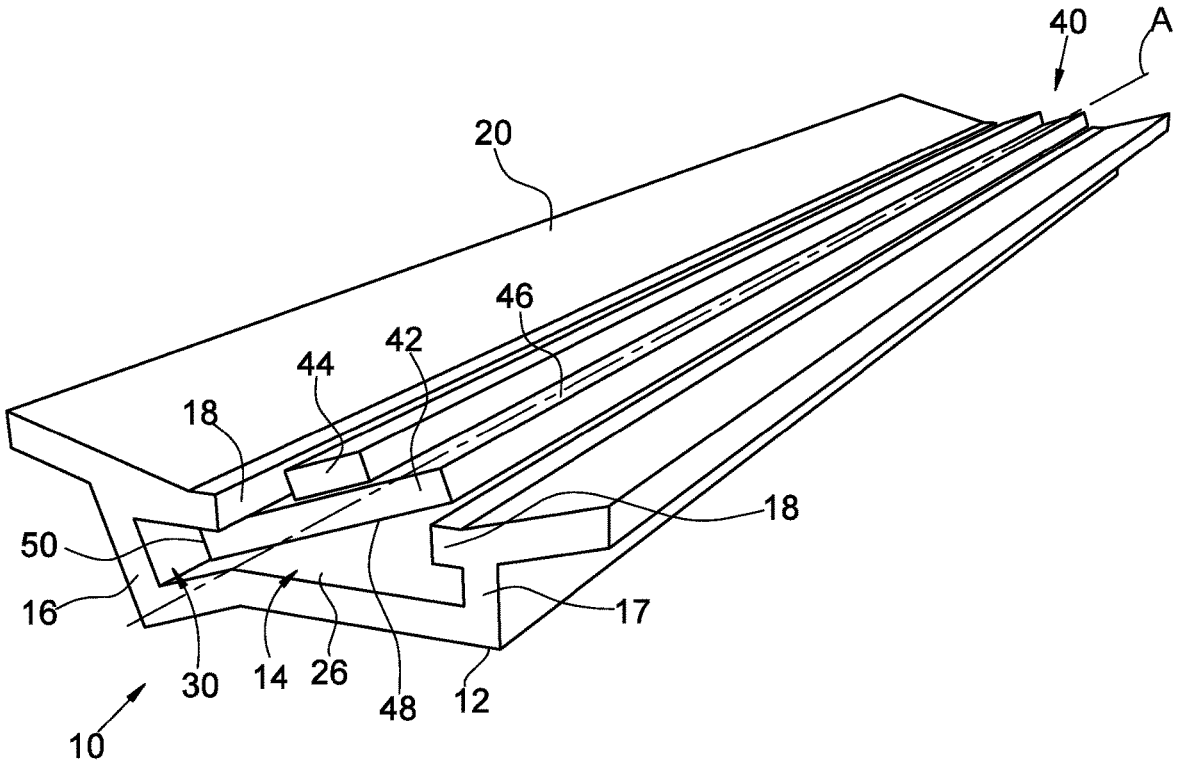
FIG. 1 is a three-dimensional view of an embodiment of a heat sink according to the invention, shown with an electronic unit which is to be mounted thereto.
Figure 2:
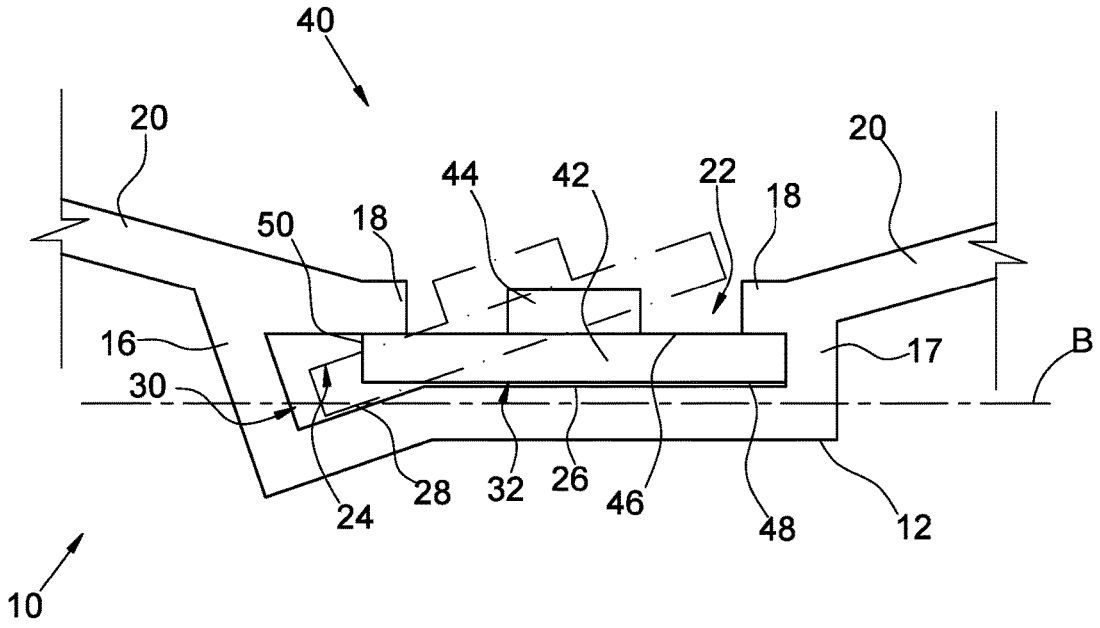
FIG. 2 is an end view of the heat sink of FIG. 1, showing two positions of the electronic unit relative to the heat sink.
Figure 3:
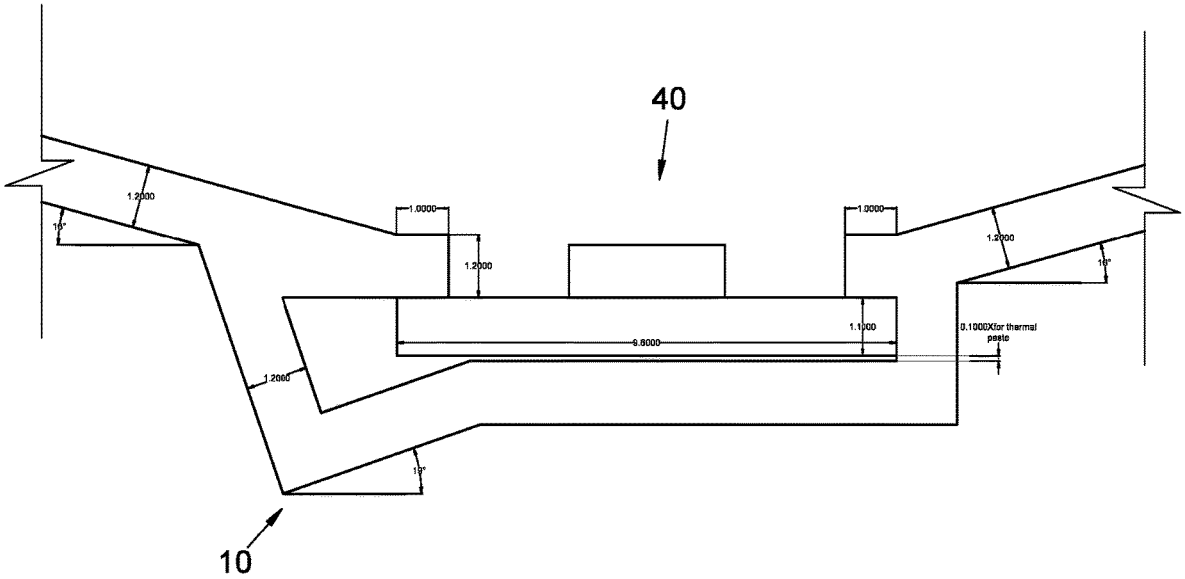
FIG. 3 is the end view of FIG. 2, illustrating dimensions of the embodiment of the heat sink and the electronic unit.

FIG. 1 to FIG. 3 illustrate an embodiment of a heat sink 10 according to the invention, along with an electronic unit 40 mountable to the heat sink 10 for operative heat exchange between the heat sink 10 and the electronic unit 40, specifically from the electronic unit 40 to the heat sink 10.

The heat sink 10 has an elongate body 12 made from a thermally conductive material, in this case aluminium. The body 12 includes a channel-shaped mounting formation formed by a pair of sidewalls 16, 17 and two opposing, parallel lips or lip portions 18, the free ends of which face inwardly toward each other, as best illustrated in FIG. 2. The channel-shaped mounting formation defines a slot 14 extending along a longitudinal axis A of the body 12. The sidewalls 16, 17 and lip portions 18 extend along the longitudinal axis A.

The body 12 further includes a pair of inclined flanges 20 on either side of the body 12. The flanges 20 extend, from respective lip portions 18, upwardly and away from the slot 14.

The slot 14 includes an outer mouth or mouth region 22 defined between the free ends of the lip portions 18 and an inner receiving region 24 defined between the sidewalls 16, 17 and above an interface surface 26 of the body 12.

The interface surface 26 is generally flat or planar, but includes a transversely inclined portion 28 which defines a nook or recess 30 in a side of the inner receiving region 24. The recess or nook 30 is further defined by one of the side walls 16 which is inclined relative to the opposite side wall 17. Similarly to the remainder of the slot 14, the recess 30 extends along the longitudinal axis A.

The electronic unit 40 includes a printed circuit board (PCB) 42 with a strip of light emitting diodes (LEDs), or LED strip 44, mounted to a component side 46 thereof. A track side 48 of the PCB 42 forms a contact surface thereof.

In this exemplary embodiment, therefore (and also in the exemplary embodiment shown in FIG. 4 to FIG. 7), the heat sink is configured as a heat sink for a heat source in the form of an LED lighting arrangement.

The channel-shaped mounting formation is configured such that the electronic unit 40 can be received in the inner receiving region 24 of the body 12 by relative angular and transverse displacement of the electronic unit 40 and the body 12, as will become apparent from the following discussion.

The mouth region 22 has a width, taken along a transverse axis B of the body 12, which is less than a width of the electronic unit 40 (i.e. the width of the PCB 42). The inner receiving region 24 has a width, taken along the transverse axis B, which is greater than the width of the electronic unit 40.

The shape and configuration of the mouth region 22 and the receiving region 24, together with the recess 30 in the receiving region 24 formed by the inclined portion 28 of the interface surface 26 and by the inclined sidewall 16, permit the electronic unit 40 to be received in the receiving region 24 via the mouth region 22. This is achieved by angling the electronic unit 40 relative to the body 12 such that the contact surface extending along a transverse axis of the electronic unit 40 is inclined relative to the transverse axis B of the body 12, inserting a side 50 of the electronic unit 40 into the receiving region 24 and the specifically into the recess 30 thereof, and angling the electronic unit 40 relative to the channel-shaped mounting formation of the body 12 such that the contact surface of the electronic unit 40 is parallel to and contiguous with the interface surface 26 and the transverse axis of the electronic unit is generally parallel to or coplanar with the transverse axis B of the body 12 and the electronic unit 40 is held captive in the receiving region 24 by the channel-shaped mounting formation, particularly by the lip portions 18. To ensure that the electronic unit 40 is held captive in the inner receiving region 24, the electronic unit 40 may be displaced transversely away from the recess 30 in the direction of the transverse axis B of the body 12.

FIG. 2 illustrates, in broken lines, a first position of the electronic unit 40, in which it is angled or inclined relative to the interface surface 26 of the body 12 and partially inserted into the receiving region 24 and recess 30, and, in solid lines, a second position of the electronic unit 40, in which it is held captive in the channel-shaped mounting formation, as explained above.

The interface surface 26 of the body 12 is configured to mate with or be in abutment with the contact surface of the PCB 42, which is provided by its track side 48. The body 12 may be configured such that, when the electronic unit 40 is received in the receiving region 24, provision may be made for a gap 32 to exist between the interface surface 26 and the contact surface 48, as illustrated in FIG. 2, to provide for a thermal paste. In a preferred embodiment, however, the surfaces 26, 48 must be contiguous for effective heat dissipation.

FIG. 3 provides, primarily as an example, dimensions and angles of the heat sink 10 and the electronic unit 40.

In use, a thermally conductive substance or compound, such as a thermal paste (not shown), may be provided in the gap 32. Thermal paste is typically applied to the interface surface 26 of the body 12 before mounting the electronic unit 40 to the body 12. In this exemplary embodiment, the gap 32 is dimensioned such that a thermal paste layer having a thickness of about 0.1 mm can be applied. Thermal paste may also be applied to the contact surface of the electronic unit 40.

The heat sink 10 is described primarily for illustrative purposes and it should be appreciated that a heat sink, in accordance with the invention, may typically and preferably include not only a channel-shaped mounting formation as shown in FIG. 1 to FIG. 3, but also a heat dissipation portion depending from a side of the body opposite to the channel-shaped mounting formation for heat exchange with a fluid medium (e.g. air or liquid).

Figure 4:
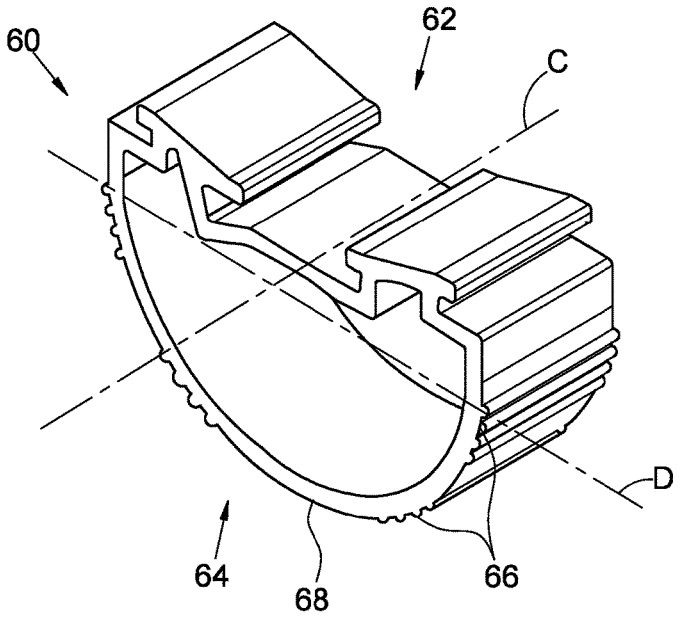
FIG. 4 is a three-dimensional view of a portion of an embodiment of a heat sink according to the invention.
Figure 5:
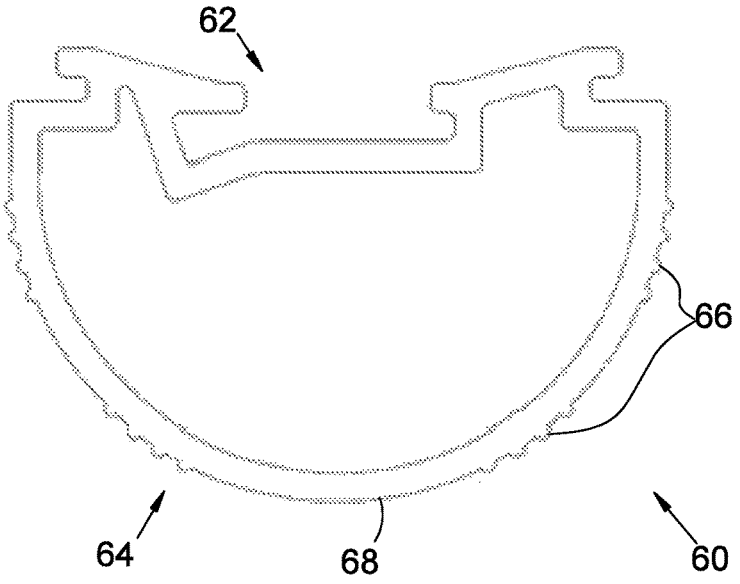
FIG. 5 is an end view of the portion of the heat sink of FIG. 4.

Accordingly, FIG. 4 to FIG. 7 illustrate another embodiment of a heat sink 60 according to the invention. In FIG. 4 and FIG. 5, only a portion of a length of the heat sink 60 is shown. It should, of course, be understood that the heat sink 60 may have any suitable length along a longitudinal axis C, which is indicated in FIG. 4.

The heat sink 60 has a base 62 including a channel-shaped mounting formation substantially similar to that of the heat sink 10 described with reference to FIG. 1 to FIG. 3, and, accordingly, the components and functioning of the base 62 will thus not be described in detail with reference to this embodiment.

The heat sink 60 further includes a heat dissipation portion 64 depending from sides of the base 62. The heat dissipation portion 64 is generally half-annular in cross-section or semi-cylindrical, as shown in FIG. 5. Four sets of longitudinally extending ribs 66 are circumferentially spaced apart about an outer surface 68 of the heat dissipation portion 64.

Figure 6:
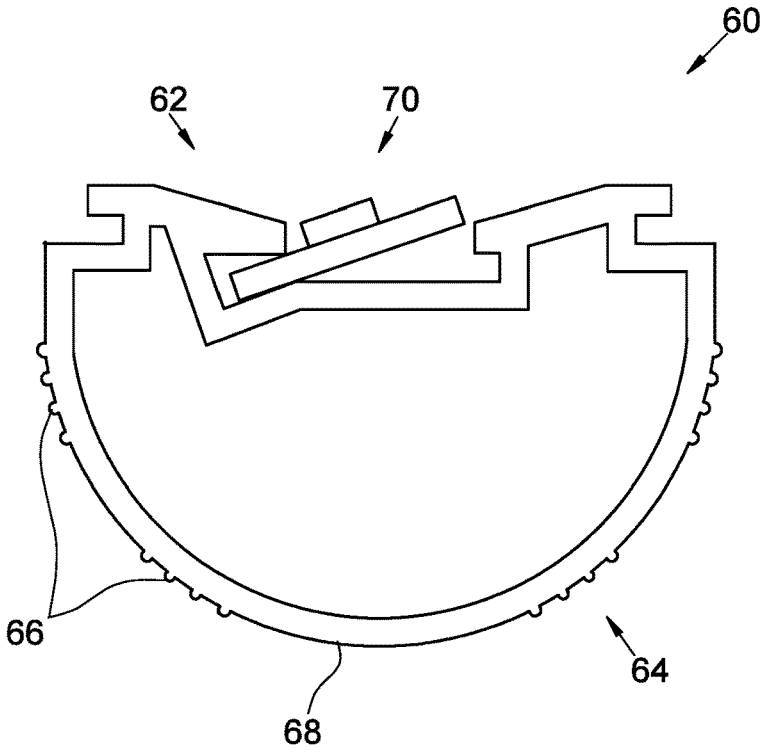
FIG. 6 is an end view of an embodiment of a heat sink according to the invention, shown with an electronic unit which is to be mounted thereto.
Figure 7:
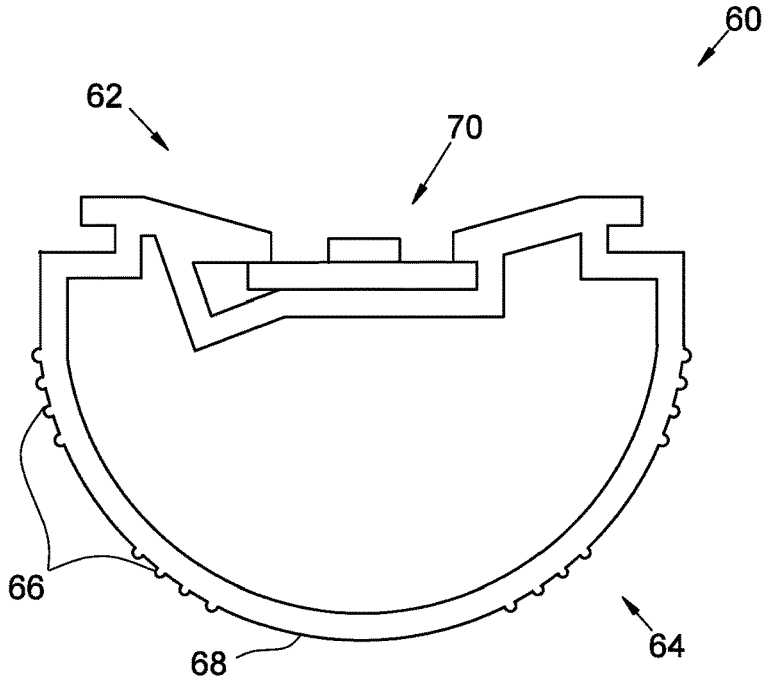
FIG. 7 is an end view of the heat sink of FIG. 6, shown with the electronic unit mounted thereto.

As a further example, FIG. 6 and FIG. 7 illustrate the manner in which a PCB 70 may be mounted to the channel-shaped mounting formation of the base 62 of the heat sink 60. This is essentially done in the same manner as described with reference to FIG. 2. In FIG. 6, the PCB 70 is angled or inclined relative to an interface surface of the base 62, and relative to a transverse axis D of the base 62 shown in FIG. 4, and a side of the PCB 70 is inserted into a recess or nook formed in a side of an inner receiving region of the base 62.

With reference to FIG. 7, the PCB 70 is then angularly displaced relative to the channel-shaped mounting formation of the base 62 and then moved transversely away from the recess or nook until the PCB 70 is held captive in channel-shaped mounting formation of the base 62.

The Applicant believes that the present invention provides an improved heat sink and an advantageous method of mounting an electronic unit to a heat sink. By forming a thermally conductive material into a body including a channel-shaped mounting formation which defines a slot as described herein, numerous advantages may be obtained.

The shape and dimensions of the heat sink described herein permit the length and a portion of the width of the electronic unit 40 or PCB 70, to be received in the channel-shaped mounting formation of the heat sink when the electronic unit is angled or inclined relative to the heat sink such that the electronic unit is inclined to a certain extent relative to the transverse axis D of the heat sink. The electronic unit 40 can then be held captive in the heat sink by further angular and transverse displacement relative to the channel-shaped mounting formation. The heat sink is configured removably to hold the electronic unit captive in the inner receiving region.

The Applicant has found that it may be easier to apply thermal paste evenly and to provide a relatively thin layer thereof when using the heat sink 10, 60 and technique of the present invention, as opposed to the conventional technique of longitudinally sliding a PCB and a heat sink in relation to each other. Further, the Applicant has found that the present invention makes it easier to ensure that an entire interface or contact surface area between the electronic unit and heat sink, or a substantial portion thereof, is covered with thermal paste. As a result improved heat dissipation via the heat sink is achieved.

The Applicant has also found that relative angular and transverse displacement, as permitted by the present invention, may be less damaging to the components involved, particularly electronic components or electrical connections or tracks on the PCB.

As mentioned above, those skilled in the relevant art will recognise that many changes can be made to the embodiments described, while still attaining the beneficial results of the present invention. A number of such possible changes are briefly described below, with reference to a further embodiment of a heat sink 80, which is conceptually illustrated in FIG. 8.

Firstly, it is envisaged that the heat sink 80 may be provided with a spacer or stopper 82 configured to be received in a nook or recess 84 in a side of an inner receiving region 86 of the heat sink 80, as described above. The stopper 82 may be manufactured from a resilient material and, in use, may be received between a side of the electronic unit (not shown) and an inclined sidewall 88 of the heat sink 80 such that lateral movement of the electronic unit is substantially prevented from occurring. The stopper 82 may therefore serve to bias the electronic unit toward an opposite side of the channel-shaped mounting formation. The stopper 82 may be removable from the body.

Secondly, it is envisaged that shims 90, 92 may be provided which are configured to be removably inserted between an underside of each lip portion 94, 96 and a side region of the component side of the electronic unit (not shown) when the electronic unit is received in the receiving region 86. This is illustrated by the directional arrows 98, 100 in FIG. 8. The shims 90, 92 may then act to urge the electronic unit downwardly towards and into abutment with the interface surface 104 of the heat sink 80 or into contact with the thermal paste provided between the electronic unit and the heat sink.

Thirdly, it is envisaged that an underside 102 of the lip portion 96 on the opposite side of the recess 84 may be wedge shaped or inclined so as to urge a side of the electronic unit in the direction of the interface surface 104 of the heat sink when the electronic unit is moved transversely towards the lip portion 96 to capture or wedge the electronic unit in the receiving region 86.

Figure 9A:
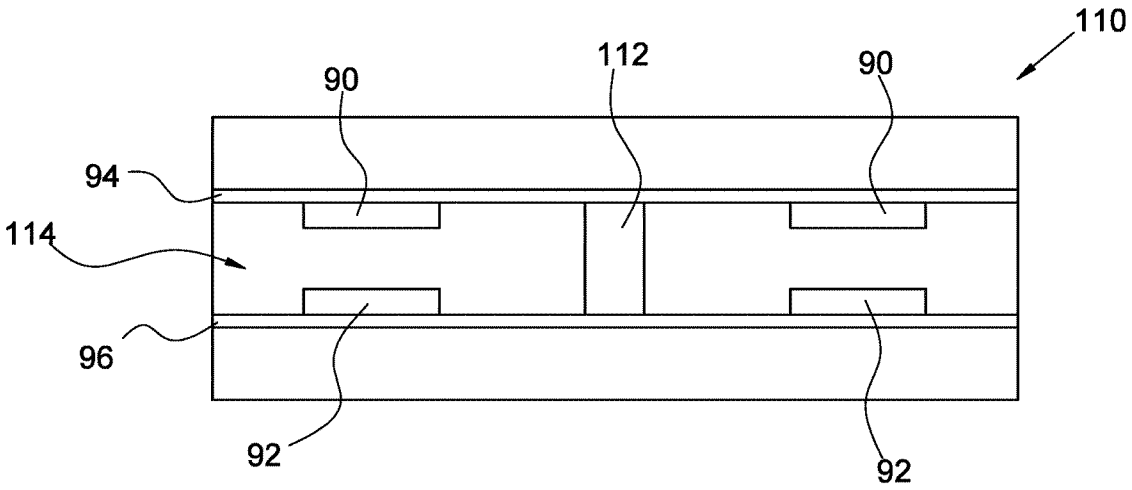
FIGS. 9A and 9B show top views of a further embodiment of a heat sink according to the invention.
Figure 9B:
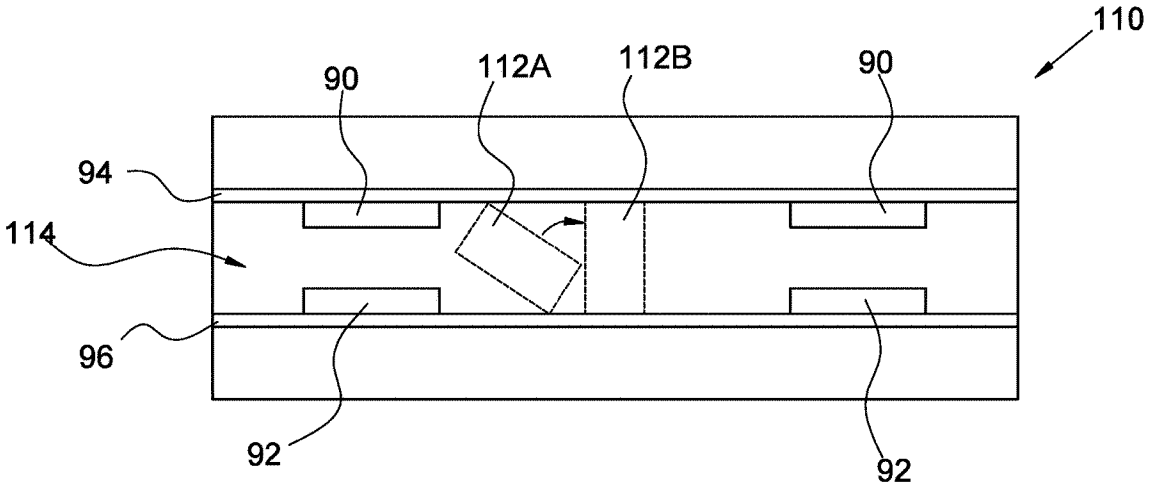

A further embodiment of a heat sink 110, which includes another envisaged change, is conceptually illustrated in FIGS. 9A and 9B.

Figure 8:
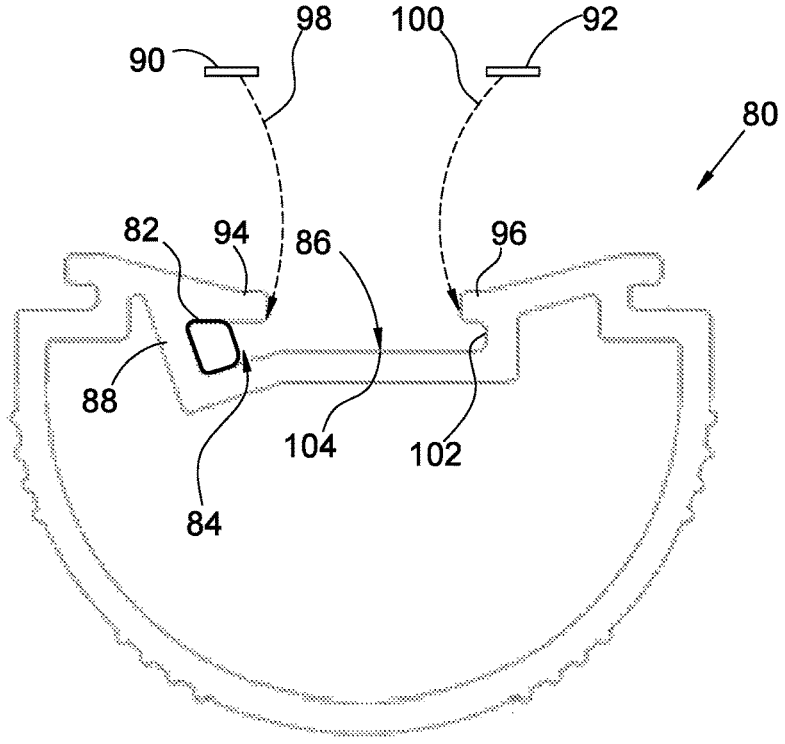
FIG. 8 is an end view of a further embodiment of a heat sink according to the invention.

The heat sink 110 is provided with shims 90, 92 as illustrated in and described with reference to FIG. 8. The heat sink 110 is additionally provided with a transverse shim 112 which is shaped and dimensioned such that a length of the shim 112 operatively extends across the entire width of the mouth region 114 of the heat sink.

Respective ends of the shim 112 are operatively received under the lip portions 94, 96 and the shim 112 acts to urge the electronic unit downwardly towards the heat sink 110, in use. Broken lines 112A, 112B in FIG. 9B indicate the manner in which the shim 112 may be slid and/or urged into position.

Instead of providing separate shims on each side of the mouth region 114, one or more transverse shims 112 may thus be employed. In some embodiments, and as shown in FIG. 9A, both types of shims 90, 92, 112 may be employed. In cases where electronic components, e.g. LEDs, are spaced apart along the PCB, the transverse shim 112 may be dimensioned so as to be fitted between such electronic components along the length of the PCB. The shim may, for example, be about 4 mm in width.

Figure 10:
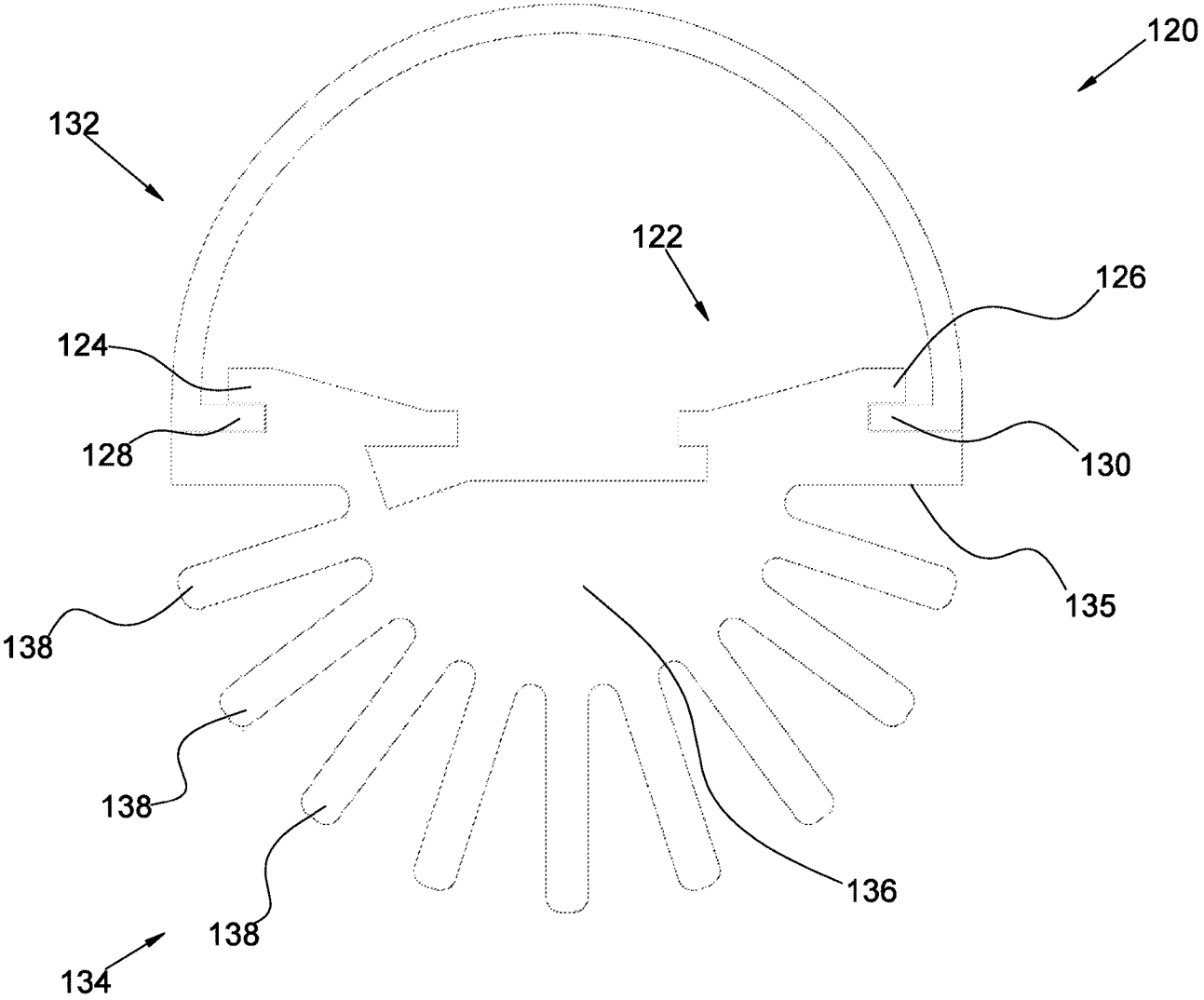
FIG. 10 is an end view of a further embodiment of a heat sink according to the invention.

Another embodiment of a heat sink 120 is illustrated in FIG. 10. The heat sink 120 has a base 122 having a channel-shaped mounting formation with components substantially similar to the channel-shaped mounting formation of the body 12 of the heat sink 10 described with reference to FIG. 1 to FIG. 3, and the components and functioning of the base 122 will thus not be described in detail with reference to this embodiment.

The base 122 includes a pair of flanges 124, 126 similar to the flanges 20 of the embodiment of FIG. 1 to FIG. 3. However, end regions of the flanges 124, 126 are provided with mounting slots which are configured to receive complementally shaped free ends 128, 130 of a generally half-annular or semi-cylindrical cover portion 132.

In this exemplary embodiment, the cover portion 132 is made from a transparent or translucent plastics material and is configured to cover an electronic unit mounted to the heat sink 120, in use. The flanges 124, 126 may also serve as reflector plates to reflect light radiated by the electronic unit.

The heat sink 120 further includes a heat dissipation portion 134 on a side of the base 122 opposite the channel-shaped mounting formation. The heat dissipation portion 134 is integrally formed with the base 122 and extends away from an underside 135 of the base 122. The base 122 and the heat dissipation portion 134 are, in this embodiment, made from aluminium.

The heat dissipation portion 134 has a solid core region 136 which is generally semi-circular in cross-section. A plurality of fins 138 are circumferentially spaced apart about the core region 136 and extend radially away from the core region 136. The fins 138 provide a relatively large surface area for enhanced heat dissipation, as will be well understood by those of ordinary skill in the art in question.

Figure 11:
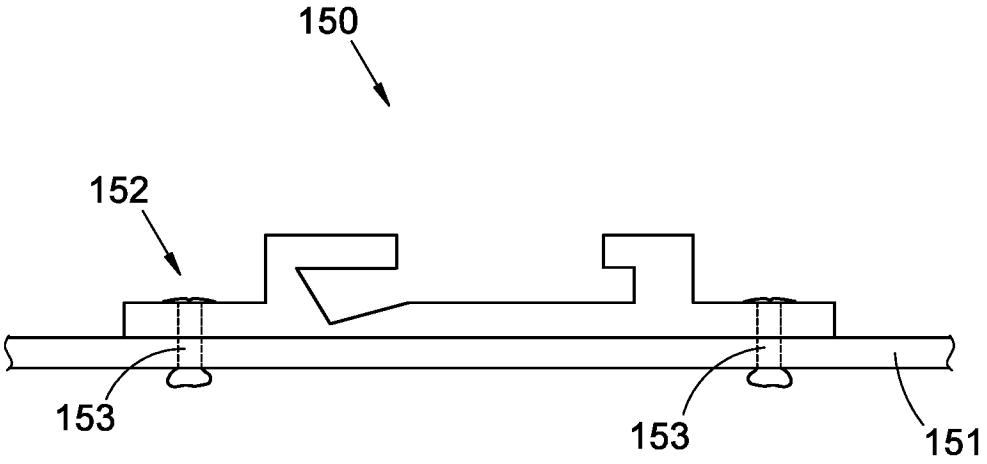
FIG. 11 shows an end view of yet another embodiment of a heat sink in accordance with the invention mounted to a planar mounting plate.

Yet another embodiment of a heat sink 150 in accordance with the invention is illustrated in FIG. 11. This heat sink 150 may be mounted to a substantially planar mounting plate 151 of a light fitting in order to improve heat dissipation from light sources in the form of one or more LED strips (not shown). In a conventional light fitting, LED light strips may be fastened to the mounting plate at discrete points. As a result, air gaps exist between the LED strips and the mounting plate which give rise to inadequate heat dissipation from the LED strips which could potentially damage the LEDs shortening their operative life span.

The heat sink 150 in accordance with the invention includes a body having a channel-shaped mounting formation, as previously described, and a heat dissipation portion 152. The heat dissipation portion 152 is in the form of planar flanges or plates which extend laterally from opposite sides of the channel-shaped mounting formation. The heat dissipation portion 152 defines a substantially planar base for mounting to the mounting plate 151. The heat dissipation portion 152 has attachment formations or holes 153 for fitting the heat sink 150 to the mounting plate 151 of the light fitting. Rivets can be used to fasten the heat sink 150 to the mounting plate 151 via the holes 153. Thermal paste is applied to improve heat dissipation between the heat sink 150 and the mounting plate 151. The mounting plate 151 therefore effectively becomes an extension of the heat sink 150 which gives rise to very effective heat dissipation.

What is claimed is:

1. A heat sink having a body that comprises a first end and a second end and a channel-shaped mounting formation configured to hold an electronic unit captive therein, the channel-shaped mounting formation defining a mouth having a transverse width that is less than a width of the electronic unit, and a nook that is configured to permit mounting of the electronic unit to the heat sink by passing the electronic unit through the mouth and angularly displacing the electronic unit relative to the mounting formation of the body;

wherein the body is elongate and configured for heat exchange with the electronic unit and wherein the channel-shaped mounting formation defines a slot extending along a longitudinal axis of the body, the slot bein configured to receive the electronic unit by relative angular and transverse displacement of the electronic unit and the mounting formation of the body, the mounting formation further being configured removably to hold the electronic unit captive in the slot;

wherein the body comprises a planar interface surface connected between the first and second ends of the heat sink and the heat sink is formed from continuous material between the first end and second end such that there are no breaks in the planar interface which forms part of body between the first and second ends and the first and second ends are connected to each other.

2. A heat sink as claimed in claim 1, wherein the mounting formation is configured to removably hold the electronic unit captive therein.

3. A heat sink as claimed in claim 1, wherein the slot comprises the mouth and an inner receiving region that comprises the nook that is disposed toward one side, wherein the inner receiving region has a transverse width that is greater than the width of the electronic unit, the inner receiving region being configured to permit the electronic unit to be received therein via the mouth by relative angular and transverse displacement of the electronic unit and the body.

4. A heat sink as claimed in claim 3, wherein the channel-shaped mounting formation is configured such that the electronic unit is receivable in the nook of the inner receiving region via the mouth by:

angling the electronic unit relative to the mounting formation such that the electronic unit is inclined relative to an interface surface of the mounting formation;

inserting a side of the electronic unit into the nook of the inner receiving region; and angularly displacing the electronic unit relative to the mounting formation about the longitudinal axis until the electronic unit is contiguous with the interface surface of the mounting formation and is held captive in the inner receiving region.

5. A heat sink as claimed in claim 4, wherein, when the electronic unit is entirely received within the inner receiving region, a contact surface of the electronic unit is in abutment with the interface surface of the mounting formation.

6. A heat sink as claimed in claim 5, wherein a thermally conductive substance or compound is sandwiched between the contact surface of the electronic unit and the interface surface of the mounting formation to facilitate effective heat dissipation from the electronic unit to the body of the heat sink.

7. A heat sink as claimed in claim 1, wherein the nook extends lengthwise and is dimensioned to permit a length and a portion of the width of the electronic unit to be received therein when the electronic unit is inclined relative to an interface surface of the mounting formation.

8. A heat sink as claimed in claim 7, wherein at least part of the nook is defined by an inclined sidewall of the mounting formation.

9. A heat sink as claimed in claim 1, wherein the channel-shaped mounting formation comprises a pair of inwardly orientated, opposing lips that extend lengthwise and define the mouth between them.

10. A heat sink as claimed in claim 9, that comprises a resilient spacer that is accommodated in the nook and is configured to urge a side of the electronic unit into abutment with the channel-shaped mounting formation to inhibit lateral or transverse movement of the electronic unit relative to the mounting formation.

11. A heat sink as claimed in claim 9, wherein a lip opposite to the nook is wedge-shaped and configured to urge the electronic unit into contact with an interface surface of the mounting formation.

12. A heat sink as claimed in claim 1, wherein the electronic unit comprises a printed circuit board (PCB) having a component side to which at least one electronic component is mounted and an opposite contact surface.

13. A heat sink as claimed in claim 12, wherein the PCB comprises a series of light emitting diodes (LEDs) on the component side thereof.

14. A heat sink as claimed in claim 1, wherein the body is made from aluminum and the channel-shaped mounting formation is configured to receive an electronic unit having a width of 75 mm or less, the electronic unit having a length of at least 100 mm.

15. A heat sink as claimed in claim 1, that comprises at least one shim removably inserted between the channel-shaped mounting formation and a component side of the electronic unit.

16. A heat sink as claimed in claim 1, wherein the body comprises a heat dissipation portion on a side of the body opposite to the channel-shaped mounting formation, the heat dissipation portion having a semi-cylindrical shape.

17. A heat sink as claimed in claim 1, wherein the body comprises a heat dissipation portion on a side of the body opposite to the channel-shaped mounting formation, the heat dissipation portion having a series of radially extending, angularly spaced apart fins.

18. A heat sink as claimed in claim 1, wherein the body further comprises a heat dissipation portion on a side of the body opposite to the channel-shaped mounting formation, the heat dissipation portion being substantially planar and having attachment formations for fitting the heat sink to a mounting plate of a light fitting such that the planar heat dissipation portion is in thermal contact with the mounting plate for effective heat dissipation.

19. A method of mounting an electronic unit to a heat sink as claimed in claim 1, the method comprising the steps of:

applying a thermally conductive substance to an interface surface of the channel-shaped mounting formation and/or to a contact surface of the electronic unit;

mounting the electronic unit to the heat sink by passing the electronic unit through the mouth and angularly and transversely displacing the electronic unit relative to the channel-shaped mounting formation of the body until the electronic unit is held captive by the mounting formation.

20. A method as claimed in claim 19, wherein the step of angularly and transversely displacing the electronic unit relative to the mounting formation comprises:

angling the electronic unit relative to the mounting formation such that the electronic unit is inclined relative to the interface surface of the mounting formation;

inserting a side of the electronic unit into the nook;

angularly displacing the electronic unit relative to the mounting formation about a longitudinal axis of the body until the electronic unit is contiguous with the interface surface of the mounting formation; and slidably displacing the electronic unit laterally away from the nook until it is held captive by the mounting formation.

21. A method as claimed in claim 19, that comprises:

inserting a resilient spacer into the nook before the electronic unit is mounted to the heat sink.

22. A method as claimed in claim 19, that comprises, once the electronic unit is mounted to the channel-shaped mounting formation, inserting a shim between the mounting formation and a component side of the electronic unit.

* * * * *